US006918276B2

(12) United States Patent
Van Parys

(10) Patent No.: US 6,918,276 B2
(45) Date of Patent: Jul. 19, 2005

(54) CONTROL DEVICE FOR A LOCK MECHANISM

(76) Inventor: Remi Emiel Van Parys, Zultseweg 120, Waregem (BE), 8790

( * ) Notice: Subject to any disclaimer, the term of this patent is extended or adjusted under 35 U.S.C. 154(b) by 307 days.

(21) Appl. No.: 10/246,454

(22) Filed: Sep. 19, 2002

(65) Prior Publication Data

US 2003/0094023 A1 May 22, 2003

(30) Foreign Application Priority Data

Sep. 19, 2001 (BE) ..... 2001/0604

(51) Int. Cl.[7] ..... E05B 65/12
(52) U.S. Cl. ..... 70/257; 70/224; 70/275
(58) Field of Search ..... 70/257, 256, 224, 70/207, 209, 275, 278.3, 278.1, 279.1, 277; 292/22, 39, 142, 144

(56) References Cited

U.S. PATENT DOCUMENTS 5,018,375 A * 5/1991 Tully ..... 70/472
5,421,178 A * 6/1995 Hamel et al. ..... 70/283
5,544,507 A * 8/1996 Lin ..... 70/107
5,694,798 A * 12/1997 Nunez et al. ..... 70/283
6,244,084 B1 * 6/2001 Warmack ..... 70/278.1
6,334,636 B1 * 1/2002 Huang et al. ..... 292/144
6,418,764 B1 * 7/2002 Lerchner ..... 70/279.1
6,460,903 B1 * 10/2002 Ming-Chih ..... 292/172
6,581,426 B2 * 6/2003 Bates et al. ..... 70/278.7

FOREIGN PATENT DOCUMENTS

| | | |
|---|---|---|
| DE | 3606531 | 9/1987 |
| DE | 29620075 | 5/1998 |
| DE | 19807553 | 7/1999 |
| EP | 276037 | 7/1988 |
| WO | WO 92/22720 | 12/1992 |

* cited by examiner

*Primary Examiner*—John B. Walsh
(74) *Attorney, Agent, or Firm*—James Creighton Wray; Meera P. Narasimhan

(57) ABSTRACT

The present invention concerns a control device for a lock mechanism, in particular a lock mechanism comprising a housing; a hollow hand knob to be pressed on which is mounted on the housing such that it can rotate and which has a far end with teeth inside this housing; an electric motor situated in the hollow hand knob, applied on the housing in a fixed manner and situated with its drive shaft in this housing; a mesh element mounted in the housing in a rotatable manner and provided with teeth for meshing with a key part of the lock mechanism and a gear wheel which can be axially moved by the hand knob.

21 Claims, 4 Drawing Sheets

CONTROL DEVICE FOR A LOCK MECHANISM

This application claims the benefit of Belgian Application No. 2001/0604 filed Nov. 19, 2001.

BACKGROUND OF THE INVENTION

1. Field of the Invention

The present invention concerns a control device for a lock mechanism, in particular a lock mechanism with a cylinder, which control device can operate the lock mechanism with a key as well as with a motor.

2. Discussion of the Related Art

The operation of lock mechanisms with a key may sometimes give rise to problems, for example because the keyhole cannot be found in the dark, or because people do not have a steady hand and find it difficult to put the key in the keyhole.

That is why remote-controlled key mechanisms have been developed, for example with a built-in transmitter in the head of the key.

Special lock mechanisms are used to this end with an internal electric motor for moving the dead bolt.

Due to the built-in motor, these special lock mechanisms are relatively large and as a result difficult to be built in in a door.

SUMMARY OF THE INVENTION

The invention aims a control device for a lock mechanism enabling a manual as well as a motor-driven operation of the lock mechanism, but which does not have the above-mentioned disadvantages and which can operate lock mechanisms of different types, both new and existing ones, without these lock mechanisms having to be adapted.

This aim is reached according to the invention by means of a control device comprising a housing; a hollow hand knob which is mounted on the housing such that it can rotate at least at an angle, which has a far end with teeth inside the housing, and which can be moved between a non-pressed and a pressed position; an electric motor situated in the hollow hand knob, applied on the housing in a fixed manner and situated with its drive shaft in this housing; a mesh element mounted in the housing in a rotatable manner and provided with teeth for meshing with a key part of the lock mechanism, and a gear wheel which can be axially moved by the hand knob, whereby the hand knob is coupled with its teeth to the teeth of the mesh element in one position by means of gear wheel transmission, whereas, in another position, its teeth are detached from the teeth of the mesh element, but it pushes the movable gear wheel in a position in which the latter couples the drive shaft of the motor by means of at least one gear wheel transmission to said teeth of the mesh element, whereas said movable gear wheel, in the first-mentioned position of the hand knob, is situated in the position in which it detaches the drive shaft of the motor from the teeth of the mesh element.

Actually, the control device only takes over the function of the key of the lock mechanism. The gear wheel transmissions make it possible for the mesh element to exert a relatively large force on the lock mechanism with a relatively small motor.

The drive shaft of the motor is preferably situated next to the geometrical axis of the mesh element, and the teeth of the hand knob are external teeth.

In this manner can be obtained a relatively compact whole which extends minimally outside the door.

According to a preferred embodiment, the movable gear wheel couples the teeth of the mesh element to the drive shaft in one position by means of two gear wheel transmissions, namely a gear wheel transmission between the movable gear wheel and the drive shaft of the motor, and a gear wheel transmission between the movable gear wheel and the teeth of the mesh element.

The gear wheel transmission between the drive shaft and the movable gear wheel may comprise a hollow intermediate gear in which the movable gear wheel can be axially displaced, without being rotatable in relation to said intermediate gear.

The gear wheel transmission between the movable gear wheel and the teeth of the mesh element may coincide partially or even entirely with the gear wheel transmission between the external teeth of the hand knob and the teeth of the mesh element.

The gear wheel transmission between the movable gear wheel and the mesh element can be restricted to a single gear wheel which clutches in the teeth of the mesh element.

The mesh element is preferably a gear wheel with at least one recess, for example a groove to receive the key element, i.e. the reduced head of a normal key of a cylinder or of a wing which is fixed to the rotor of a cylinder.

The electric motor is preferably controlled by means of a wireless remote control.

BRIEF DESCRIPTION OF THE DRAWINGS

In order to better explain the characteristics of the invention, the following preferred embodiment of a control device for a key mechanism according to the invention is described as an example only without being limitative in any way, with reference to the accompanying drawings, in which.

DETAILED DESCRIPTION OF THE PREFERRED EMBODIMENTS

Figure 1:
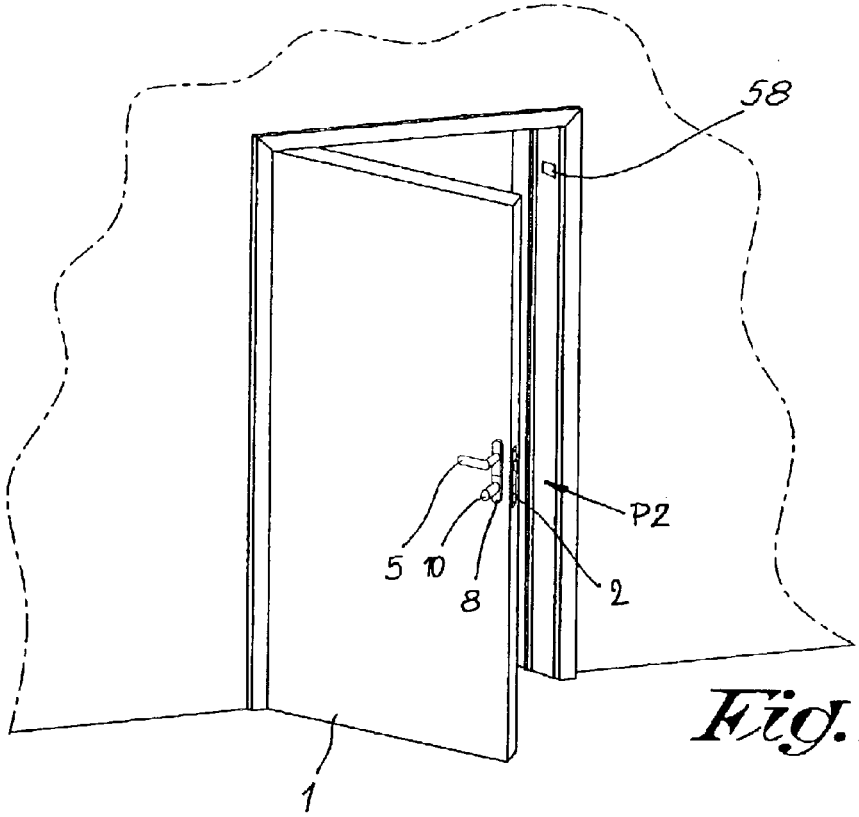
FIG. 1 represents a door provided with a control device according to the invention.
Figure 2:
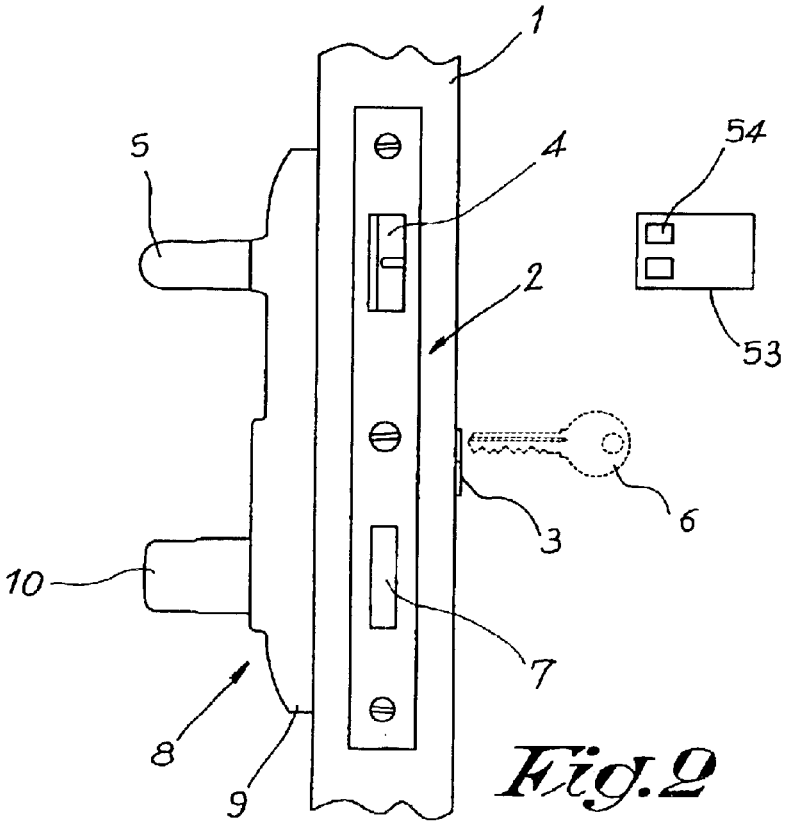
FIG. 2 shows a view according to arrow P2 in FIG. 1 to a larger scale.

FIGS. 1 and 2 represent an entrance door 1 provided with a conventional lock mechanism 2 with a cylinder 3. The single lock 4 can be operated in the usual manner by means of a handle 5 provided on the inside of the door 1, whereas this single lock 4 as well as the night latch 7 can be operated from the outside with a key 6.

The single lock 4 and the night latch 7 can be operated by means of a control device 8 according to the invention from the inside as well as from the outside.

As is represented in detail in FIGS. 3 to 7, this control device 8 comprises a housing 9 provided on the inside of the door 1; a hollow hand knob 10 provided on the housing such that it can rotate at an angle and can be axially moved over a distance; an electric motor 11 erected in this hollow hand knob 10 fixed to the housing 9 by means of a holder 12.

In order to make it possible to mount parts inside the housing 9, it consists of a front wall 13 through which the handle 5 and the hand knob 10 extend, and a back wall 14 in two parts which is screwed against the front wall 13. For clarity's sake, the back wall 14 has been left out in FIG. 4. The handle 5 is fixed to the front wall 13 in a non-represented rotatable manner, analogous to the manner in which it is normally mounted to a handle plate fixed on the door 1.

The hand knob 10 is pushed outward, i.e. in the non-pressed position, by means of a spring 15 surrounding the motor 11 and/or the motor holder 12 between the outermost far end of the hand knob 10 and a ring 16 provided on the motor 11 or the motor holder 12.

Inside the housing 9, the hollow hand knob 10 is provided with a collar 17 preventing the hand knob 10 from being detached from the housing 9 and from external teeth 18.

Opposite to the cylinder 3 and an opening 14' in the back wall 14 for the cylinder 3, a mesh element 19 is erected inside the housing 9 which is provided in the middle with two grooves 20 standing at right angles to one another for meshing with a part of the lock mechanism 2. This mesh element 19 forms a gear wheel and is provided with external teeth 21.

These external teeth 21 are coupled to either the external teeth 18 of the hand knob 10 by means of a gear wheel transmission 22, or to a gear wheel 24 which can be axially moved, depending on the position of the hand knob 10 as will be further explained. This common gear wheel transmission 22 is restricted to one intermediate gear 23 meshing with the teeth 21 which either meshes with the teeth 18 of the hand knob 10 or with the movable gear wheel 24.

The motor 11 comprises a drive shaft 25 inside the housing 9, and between this drive shaft 25 and the movable gear wheel 24 is also provided a gear wheel transmission 26.

This gear wheel transmission 26 comprises a driving gear wheel 27 which is fixed to the driving shaft 25, and a second intermediate gear 28 with which the movable gear wheel 24 is coupled in such a manner that it rotates along, but can also be axially moved.

In the given example, said coupling of the gear wheel 24 is possible because the intermediate gear 28 is a hollow gear wheel with grooves 29 in which mesh ribs 30 standing on the movable gear wheel 24. The movable gear wheel 24 also has teeth 31 with which it can mesh with the first intermediate gear.

According to a variant, the ribs 30 and the teeth 31 form the same teeth. The grooves 29 and the ribs 30 can be replaced by other means allowing for a movable, but non-rotatable coupling with the second intermediate gear 28, such as a tenon and mortise joint with an angular section.

A springy element 32 pushes the movable gear wheel 24 against one end of the hand knob 10.

The cylinder 3 has two rotors, namely an outer rotor 33 and an inner rotor 34 with the ring and rod 35 which can be coupled to it in between, which can be rotated inside a housing 36. The cylinder 3 can be a conventional cylinder 3, whereby every rotor 33 and 34 is provided with radial openings 37 in which pens 38 are being pushed by springs 39. A suitable key 6 can push these pens 38 outside the rotor 33 or 34, such that it can be rotated.

In this case, the mesh element 19 is coupled to the cylinder 3 via a key part 6' sticking in a recess in the shape of a groove 20. This key part is the head of a normal key 6, sawn or cut in a special shape or, as is represented in FIG. 6, a wing 6' forming a whole with the inner rotor 34.

A push element in the shape of a washer 40 situated opposite to the grooves 20 is pushed towards the back wall 14 by means of a spring 41, against the above-mentioned key part 6', so that the latter is pushed into the position in which the point 6" of the key 6 with the cut-out head or of the rotor 34 and the wing 6" as a whole meshes with the ring with the rod 35.

When a conventional cylinder 3 is used, and thus a key 6 with reduced head in the inner rotor 34, said point 6" will be pushed out of the ring with the rod 35 when a suitable key 6 is put in the outer rotor 33, which is only possible when the cut-out head or wing 6' is situated in its normal, vertical position or, for certain cylinders 3, is situated in a horizontal position.

Figure 6:
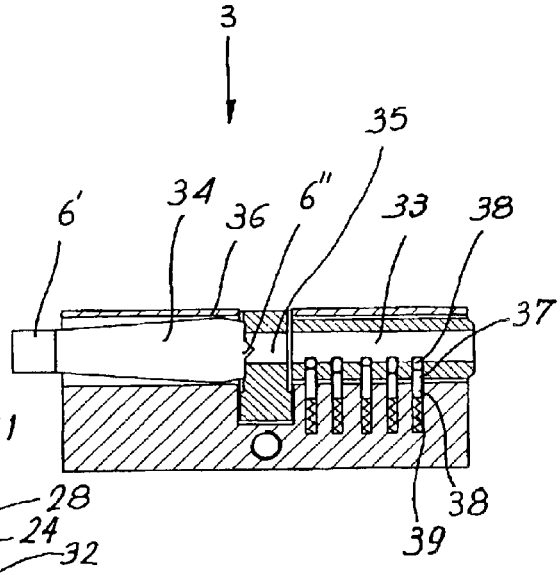
FIG. 6 represents the section of a cylinder of the lock mechanism with which the control device of the preceding figures co-operates.

Since the key part 6' remains in the rotor 34, the inner 'key' 6 is no longer required to correctly position pens 38, and the pens 38 can be omitted, as in the example represented in FIG. 6, and the inner key 6 then forms a whole with the rotor 34.

In fact, what it comes down to, is that the wing 6', which fits in a groove 20, is formed on one end of the rotor 34, and the point 6" co-operating with the ring 35 is formed on the other far end. Since the mesh element 19 and the cylinder 3 are not always situated perfectly opposite to one another as a result of the mounting, the rotor 34 will not be cylindrical, but somewhat conical in a cylindrical opening in the housing of the cylinder, such that the rotor 34 can somewhat be tilted with its longitudinal axis in the housing 36 of the cylinder 3, and the wing 6' can always penetrate inside a groove 20.

In order to allow for a correct operation of the control device 8, the starting position and end position of the key part 6' must always be the same, namely vertical or horizontal, depending on the cylinder 3, which implies that one groove 20 has to be vertically and the other horizontally directed.

In order to position the mesh element 19 such that this is the case, said mesh element 19 has a collar 42 extending in the shape of a coaxial circle with a local recess or indentation 43 which is V-shaped in the given example and in which fits a positioning piece, in the given example the triangular point of a sliding piece 44, which is pushed against the collar 42 by a spring 45. When the point is situated more or less opposite to the indentation 43, the collar 42 and thus the mesh element 19 are brought in the position in which a groove 20 is perfectly vertical, as said point is being pushed in the indentation 43.

The motor 11 is started and stopped by means of an electronic control 46 with a microcontroller 47 receiving signals from the receiver 48 of a remote control, and which thus co-operates with a transmitter 49 thereof, and from a few push buttons, namely a push button 50 for closing and a push button 50' for opening, provided next to one another on the inside of the door 1 above the handle 5 on the housing 9, and which make it possible to control the motor 11 manually by means of the control unit 47.

The control unit 47 has been programmed to make the motor 11 turn in one direction or the other according to a specific pattern, as will be further explained in the description of the operation.

The control unit 47 and the receiver 48 are provided on a printed circuit board 51 situated in the housing 9 and coupled to an antenna 52 which is formed of the outermost aluminium part of the handle 5 which is isolated from the handle pin.

The transmitter 49 has for example been worked into a key 6 of the cylinder 3 provided with the control buttons, but, as represented in FIG. 2, it can be built-in in a control box 53 provided with control buttons 54.

The control 46 coupled to the motor 11 not only receives signals from the receiver 48, but also from a digital Hall sensor 55 provided opposite to the collar 46 on the housing 9 and working in conjunction with a magnet 56 provided in the collar 46 in order to determine the position of the mesh element 19, from a sensor 57 which is erected in the housing 9 and which is controlled by the far end of the hand knob 10 in order to detect whether this hand knob 10 is either pressed or not, and from a switch 58 provided on the doorcase and which determines whether the door 1 is open or closed.

Figure 7:
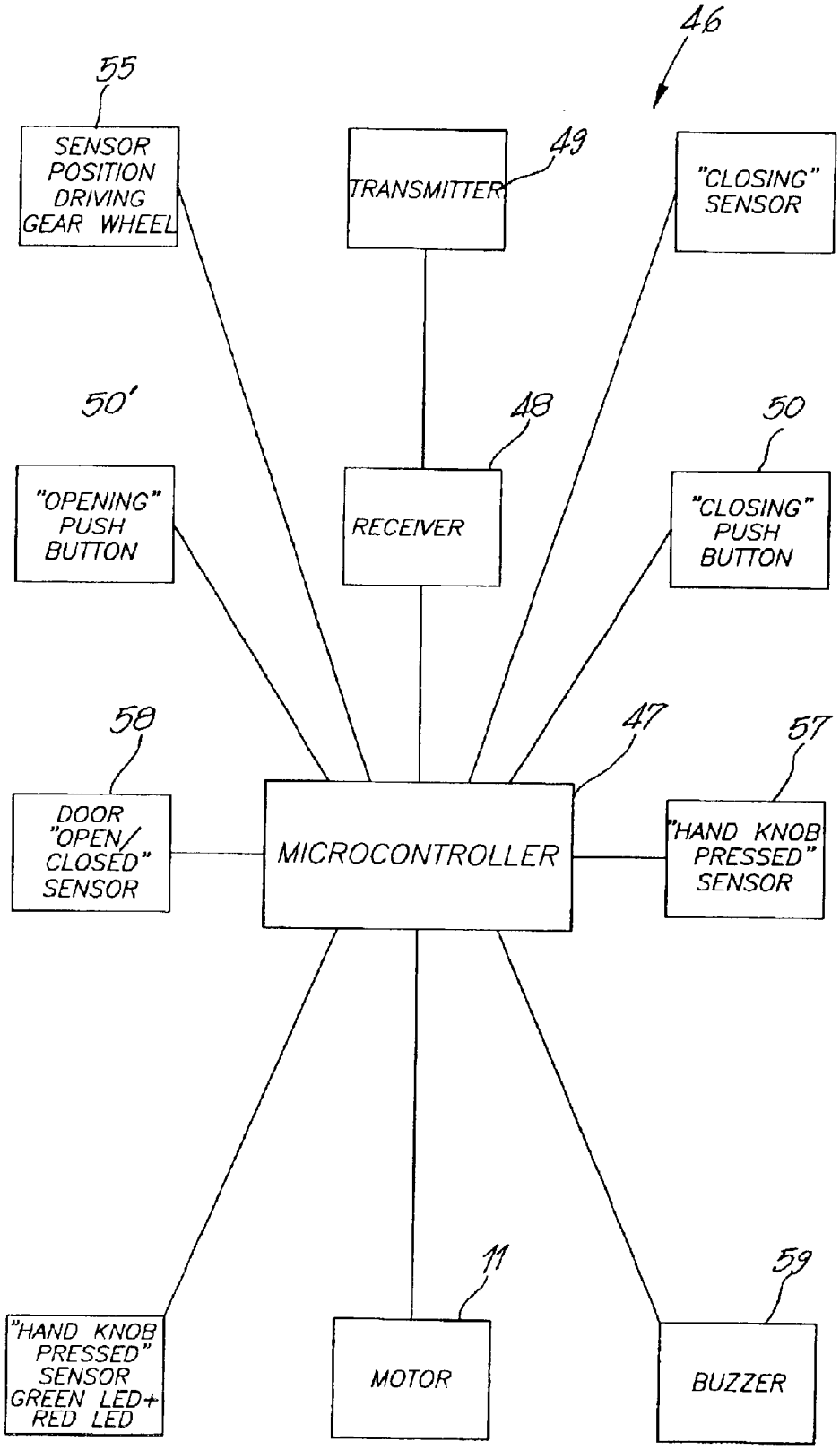
FIG. 7 is a block diagram of the electronic control of the control device.

Further, the control 46 can also receive a signal from for example a sensor which detects whether the night latch 7 is in the open or closed position, as is represented in the block diagram of FIG. 7.

Moreover, the control 46 may contain a child-proof lock which can disconnect the operation of the push buttons 50 and 50'.

To the output of the control unit 47 can also be connected a buzzer 57 emitting a sound signal when the motor 11 is working, or LED's can be connected thereto, provided in the front wall 13 and giving information regarding the condition of the control unit 8.

The control unit 8 with a handle 5 mounted upon it can be provided on the inside of an existing door 1 with a lock mechanism 2. If the lock mechanism 3 has no cylinder, as is represented in FIG. 6, the cylinder 3 has to be replaced by such a one, or a key 6 has to be put on the inside of the cylinder 3 whose head has been reduced to more or less the shape and size of the wing 6', after which the housing 9 is fixed to the door by means of screws.

The control 46 is electrically connected to the switch 58 and connected to a current feed.

Figure 3:
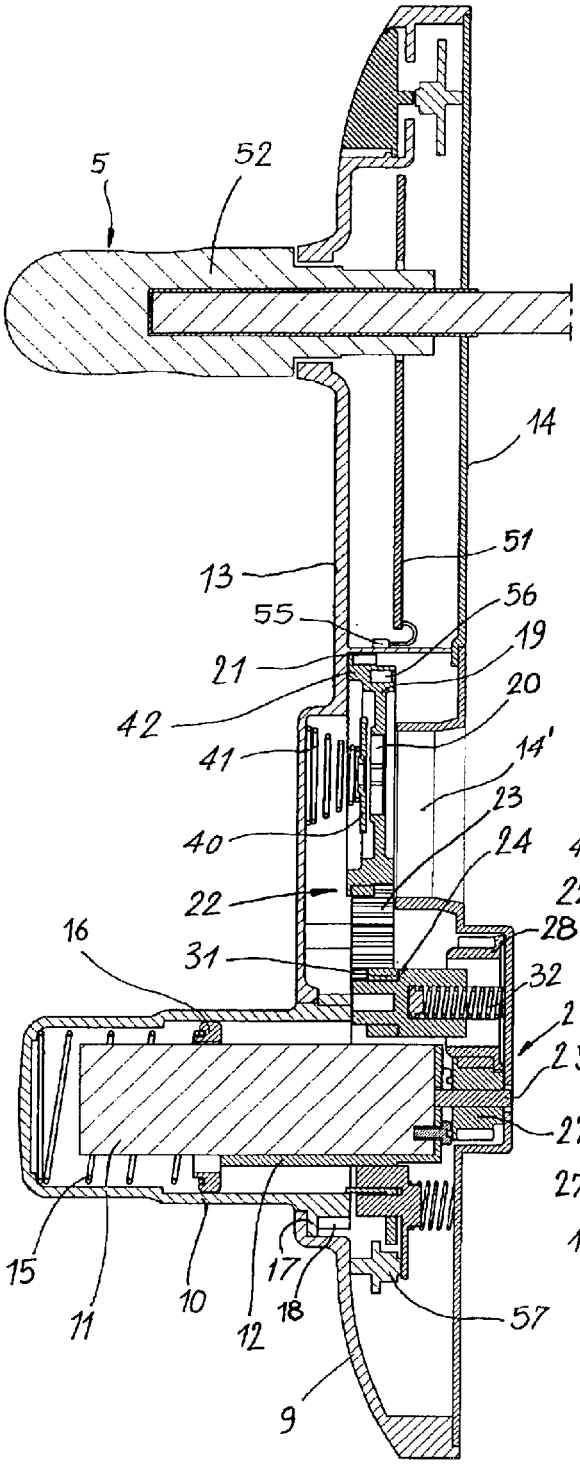
FIG. 3 represents a longitudinal section of the control device according to the invention.
Figure 4:
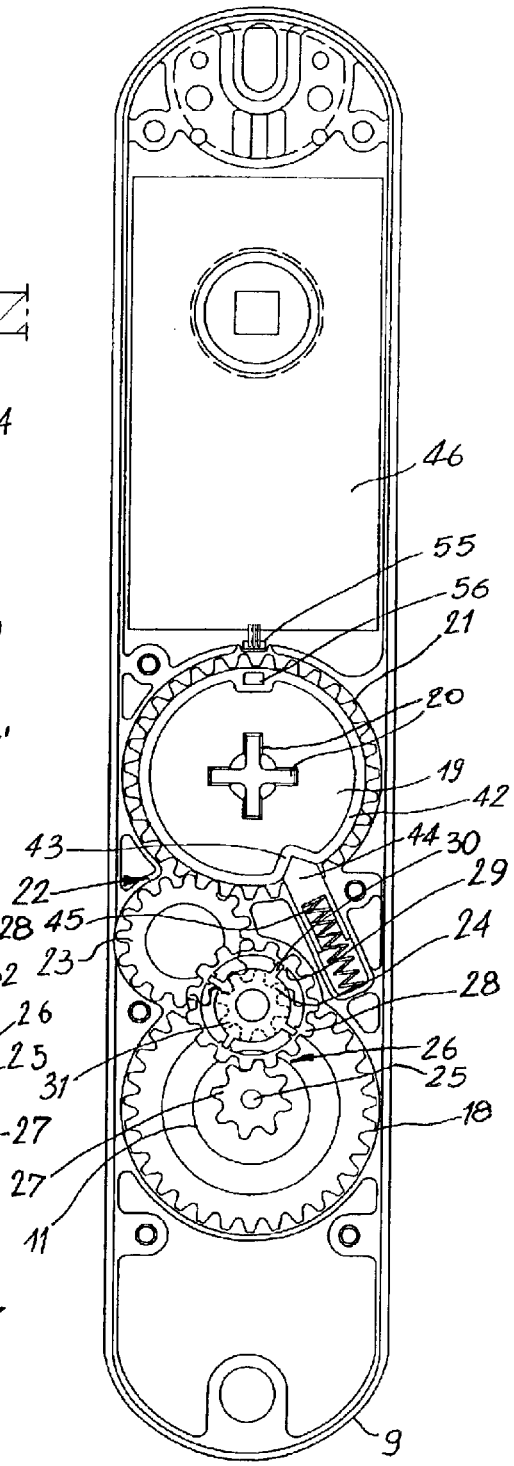
FIG. 4 represents a rear view of the control device from FIG. 1, after removal of the back wall.

When at rest, the control device 8 is in the position as represented in FIGS. 3 and 4.

The hand knob 10 is not pressed and its teeth 18 are disengaged from the intermediate gear 23. However, the latter meshes with the teeth 31 of the movable gear wheel 24. The sensor 57 has been pressed.

In order to close the lock mechanism 2 as of this position, the control knob for closing the box 53 can be pressed. The transmitter 49 will emit a signal which is received by the receiver 48. If this signal is correct, the control unit will be activated.

The control unit 47 checks whether the sensor 57 has been pressed and, hence, whether the hand knob 10 has not been pressed, whether the switch 58 is closed, in other words whether the door 1 is closed and whether the sensor checking the night latch 7 indicates that it is in the open position. Only when these conditions have been met, the control unit 47 will make the motor 11 start.

Thanks to the intervention of the gear wheel transmission 26, the movable gear wheel 24 is rotated, which in turn rotates the mesh element 19 thanks to the intervention of the gear wheel transmission 22. The wing 6' and the ring with the rod 35 of the cylinder 3 are rotated, such that the night latch 7 is put in the closed position and the door 1 is consequently locked. The wing 6' thus controls the lock mechanism 2 in the same ordinary manner as when it is manually operated by a key 6.

By setting the control unit 47, it is possible to select a clockwise or anticlockwise rotation of the motor 11 and thus of the wing 6', depending on the sense of rotation of the door 1. As a function of the lock mechanism 2, it is automatically determined or it can be set whether the wing 6' has to be revolved once or twice to put the night latch 7 in a closed position.

The Hall sensor 55 will detect when the mesh element 19 has reached the position in which the night latch 7 is situated in the above-mentioned closed position. The control unit 47 makes the motor 11 run a little longer, until the mesh element 19 has gone past said position, after which the motor 11 is reversed and the mesh element 19 is rotated somewhat back until the sliding piece 44 is situated against a flank of the indentation 43. The rotation has no influence whatsoever on the lock mechanism 2, but only the parts between the motor 11 and the cylinder 3 are moved. Finally, the motor 11 is rotated a little in the closing position again, so that a certain play is created between the motor 11 and the mesh element 19, and the sliding piece 44 can penetrate entirely in the indentation 43 and can put said mesh element 19 in the correct position with one vertically directed groove 20.

The control unit 47 can also be activated from the inside instead of by the remote control 48,49 by pressing the push button 50 for closing.

Figure 5:
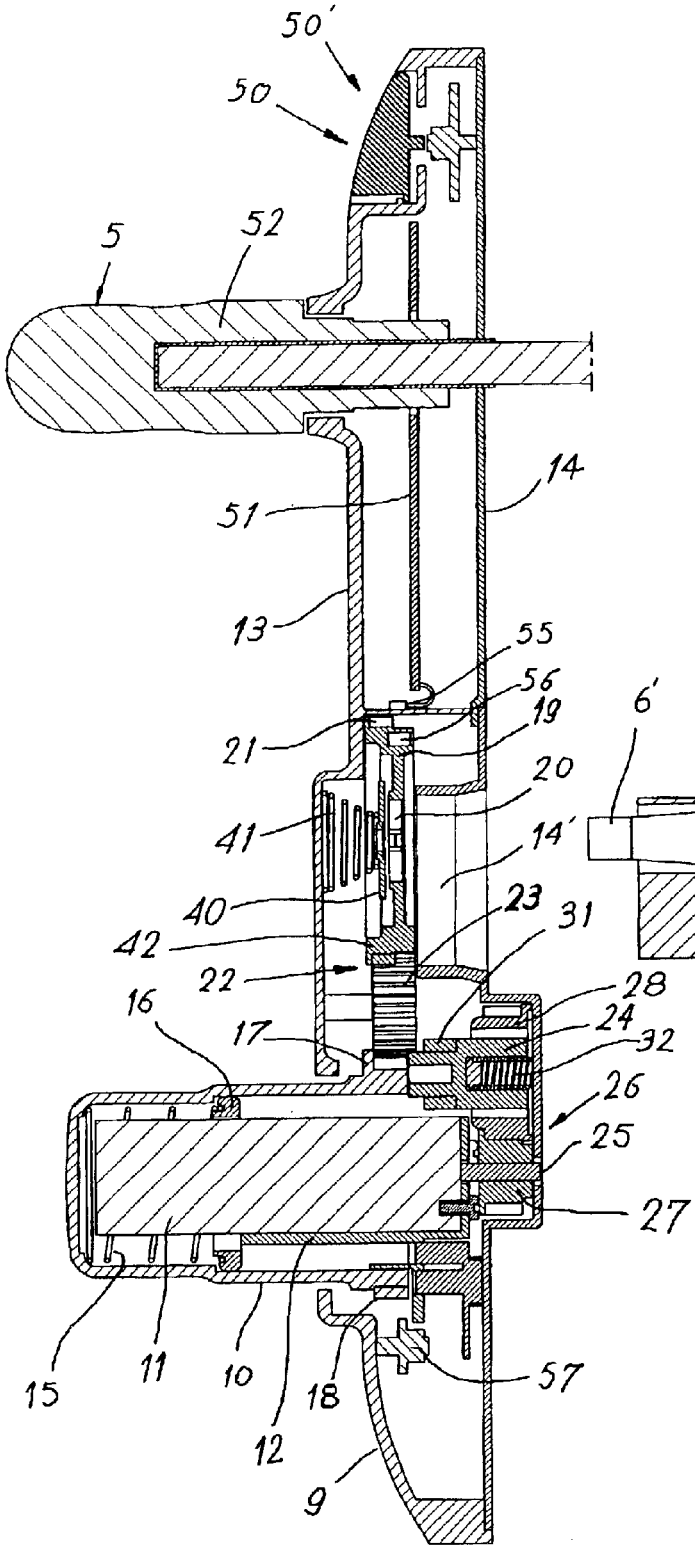
FIG. 5 represents a section analogous to that in FIG. 3, but for another condition of the control device.

An entirely manual closing is possible from the inside by pressing the hand knob 10 in the position represented in FIG. 5 and by rotating it.

When the hand knob 10 is pressed, the sensor 57 is no longer pressed, and the movable gear wheel 24 is shifted against the operation of the springy element 32, such that its teeth 31 are detached from the intermediate gear 23. The teeth 18 of the hand knob 10 will than mesh with the intermediate gear 23 instead.

When the hand knob 10 is rotated at an angle, the mesh element 19 and thus also the wing 6' are rotated through the action of the intermediate gear 23, and the lock mechanism 2 is put in a closed position in this manner.

The lock mechanism 2 can be put in the closed position from the outside by means of the key 6, which can put the lock mechanism 2 in the closed position in the usual manner. By inserting the key 6, the point 6" is pushed out of the ring 35 in a conventional cylinder 3, whereby the wing 6' pushes the washer 40 against the spring 41, so that the outer key 6 can rotate.

In an analogous manner, the night latch 7, and afterwards also the single lock 4 if necessary, can be put in the open position from the outside by means of the key 6 when the night latch 7 was in the closed position.

Also the opening up by means of the hand knob 10 is carried out in analogous manner as described for the closing. Only, the pressed hand knob 10 is now turned in the other direction until the night latch 7 and the single lock 4 have been put in the open position, such that the door 1 can be turned open.

The opening up can also be done by means of the motor 11. This is possible by pressing the opening push button 50' or by pressing the control button 54 for opening the control box 53.

By said pressing, the control unit 47 of the control 46 controls the sensor 57, and if the latter indicates that the hand knob 10 is not pressed, the control unit 47 will order the motor 11 to start in the opposite direction as described above, i.e. the opening direction.

Thanks to the gear wheel transmissions 22 and 26 and the movable gear wheel 24, the motor 11 will rotate the mesh element 19 at full speed, until both the night latch 7 and the single lock 4 have been drawn in entirely. Next, the motor 11 rotates back into the closing position, at full speed, just past the single lock position, as a result of which the cylinder is put between the single lock and night latch position. The motor 11 rotates slowly back into the opening direction until it can go no further, whereby not the lock mechanism 2, but only the cylinder 3 rotates along. Finally, thanks to a minimal rotation of the motor 11 in the closing direction, a play is created between the motor 11 and the mesh element 19 until, as described above, this mesh element 19 is pushed in the right position by the sliding piece 44 with one groove 20 directed vertically and one groove 20 directed horizontally.

With a conventional cylinder 3, the point 6" can thereby be pushed away by a key 6 which fits in the outer rotor 33.

The different stages or some error in the opening and closing procedure, for example the fact that the door 1 is open while being closed, can be indicated with signals from the above-mentioned LED's provided on the housing 9 and/or by other sound signals than those of the buzzer 59, which for example merely indicates when the closing or opening has come to an end.

The control unit 47 can be equipped with a serial output, so that the control device 8 can be connected to a domotics system.

The positioning means for the mesh element 19 do not necessarily have to comprise a sliding piece 44 with a triangular point. A bullet can be provided instead, for example.

Thanks to its construction, the above-described control device 8 is relatively compact. Nevertheless, it can exert relatively large forces on the key mechanism 2.

It can be applied to control an existing key mechanism 2. Only the head of one of the keys must be reduced to fit in a groove 20 in the mesh element 19.

The invention is by no means limited to the above-described embodiment represented in the accompanying drawings; on the contrary, such a control device can be made in all sorts of variants while still remaining within the scope of the invention.

What is claimed is:

1. A control device for a lock mechanism, in particular a lock mechanism with a cylinder, comprising a housing, a hollow hand knob rotatably mounted on the housing for rotating at least at an angle, the hand knob having a far end with teeth disposed inside the housing, the far end being movable between a non-pressed and a pressed position, an electric motor in the hand knob coupled to the housing comprising a drive shaft disposed in the housing, a mesh element mounted in the housing in a rotatable manner comprising meshing teeth for meshing with a key part of the lock mechanism, a movable gear wheel axially movable by the hand knob, at least one gear transmission wheel coupling the hand knob with the teeth to the meshing teeth of the mesh element in one position, and in another position detaching the teeth of the hand knob from the meshing teeth of the mesh element and pushing the movable gear wheel into a position for coupling the drive shaft of the motor to the meshing teeth of the mesh element, and wherein the movable gear wheel detaches the drive shaft of the motor from the meshing teeth of the mesh element in said one position.

2. The control device according to claim 1, wherein the drive shaft of the motor is situated next to a geometrical axis of the mesh element, and wherein the teeth of the hand knob are external teeth.

3. The control device according to claim 2, further comprising two gear wheel transmissions wherein, in said one position, the movable gear wheel couples the meshing teeth of the mesh element to the drive shaft by the two gear wheel transmissions, wherein one gear wheel transmission is disposed between the drive shaft and the movable gear wheel, and another gear wheel transmission is disposed between the movable gear wheel and the meshing teeth of the mesh element.

4. The control device according to claim 3, wherein the one gear wheel transmission disposed between the drive shaft and the movable gear wheel comprises a hollow intermediate gear wherein the movable gear is axially shiftable in the intermediate near without being able to rotate in relation to the intermediate gear.

5. The control device according to claim 3, wherein the another gear wheel transmission disposed between the movable gear wheel and the meshing teeth of the mesh element coincides partially or entirely with a third gear wheel transmission disposed between the external teeth of the hand knob and the meshing teeth of the mesh element.

6. The control device according to claim 3, wherein the another gear wheel transmission disposed between the movable gear wheel and the meshing teeth of the mesh element is restricted to a single gear wheel meshing with the meshing teeth of the mesh element.

7. The control device according to claim 1, wherein the mesh element is a gear wheel with at least one recess for receiving the key part of the cylinder.

8. The control device according to claim 7, wherein the key part is a reduced head of a key of the cylinder.

9. The control device according to claim 7, wherein the key part is a wing fixed on a rotor of the cylinder.

10. The control device according to claim 9, wherein the rotor is a conical inner rotor disposed in a cylindrical opening of the cylinder.

11. The control device according to claim 7, further comprising a springable push element disposed on a side of the mesh element facing away from the cylinder, and opposite to the recess, wherein the push element acts as a spring to push away the key part protruding through the recess.

12. The control device according to claim 1, further comprising a control to control the electric motor, and wherein the control comprises a wireless remote control.

13. The control device according to claim 12, wherein the control further comprises a control unit coupled to at least one of the following:

a receiver of the remote control;

a switch controlled by a door to determine whether the door is either oven or not open;

a sensor to detect position of the hand knob;

a sensor to detect whether a night latch is in a closed position;

means to detect position of the mesh element.

14. The control device according to claim 13, wherein the means to detect the position of the mesh element comprises a digital Hall sensor stationary in relation to the housing, and a magnet co-operating with the sensor disposed on the mesh element.

15. The control device according to claim 1, further comprising positioning means to position the mesh element after a rotation.

16. The control device according to claim 15, wherein the positioning means comprises a collar situated on the mesh element and provided with an indentation, and a positioning piece fitting in the indentation, wherein the positioning piece is pushed against the collar and into the indentation in a springy manner.

17. The control device according to claim 16, wherein the positioning piece is a sliding piece with a point having a shape coinciding with a shape of the indentation.

18. The control device according to claim 17, wherein the shape of the sliding piece is triangular when the indentation is V-shaped.

19. The control device according to claim 13, further comprising positioning means to position the mesh element after a rotation, wherein the control unit is programmed such that when the lock mechanism is closed by the motor the control unit makes the motor turn in a closing direction until the mesh element is situated a little past the closed position, and thereafter the rotation of the motor is reversed such that the motor makes the mesh element rotate back a little without influencing the lock mechanism, and wherein only positions of parts between the motor and the lock mechanism are altered, and the motor is finally rotated back a little in a closing direction such that the motor and the mesh element interact enabling the positioning means to dispose the mesh element into a correct position.

20. The control device according to claim 13, further comprising positioning means to position the mesh element after a rotation, wherein the control unit is programmed such that when the lock mechanism is opened by the motor the control unit makes the motor move the mesh element at full speed into a position wherein the night latch and a single lock of the lock mechanism are entirely drawn back, and thereafter making the motor rotate back at full speed in the closed position to just past a single lock position, thereby placing the cylinder between the single lock position and a night latch position, wherein the control unit further makes the motor rotate slowly in an opening direction until the motor can go no further, and wherein the lock mechanism does not rotate but the cylinder rotates and makes the motor carry out a minimal rotation in a closing direction such that the motor and the mesh element interact enabling the positioning means to dispose the mesh element into a correct position.

21. The control device according to claim 7, wherein the recess is a groove.

* * * * *